United States Patent [19]

Schiller

[11] 4,308,320

[45] Dec. 29, 1981

[54] METHOD FOR COATING AND DRYING PAPER

[75] Inventor: Gary G. Schiller, Wisconsin Rapids, Wis.

[73] Assignee: Consolidated Papers, Inc., Wisconsin Rapids, Wis.

[21] Appl. No.: 179,651

[22] Filed: Aug. 20, 1980

[51] Int. Cl.[3] ..... B05D 3/02; B05D 3/12; B32B 23/08; B32B 27/10

[52] U.S. Cl. ..... 428/511; 427/361; 427/362; 427/366; 427/382; 427/391; 428/512

[58] Field of Search ..... 427/391, 361, 362, 365, 427/366, 382; 428/511, 512, 513, 514

[56] References Cited

U.S. PATENT DOCUMENTS

| | | | |
|---|---|---|---|
| 3,268,354 | 8/1966 | Hain | 427/194 X |
| 3,338,735 | 8/1967 | Hain | 427/361 X |
| 3,873,345 | 3/1975 | Vreeland | 427/361 X |
| 4,112,192 | 9/1978 | Vreeland | 427/391 X |
| 4,241,143 | 12/1980 | Ashie et al. | 427/391 X |

*Primary Examiner*—Michael R. Lusignan
*Attorney, Agent, or Firm*—Gary, Juettner & Pyle

[57] ABSTRACT

A coated paper having high bulk, excellent gloss and low surface mottle is prepared by first coating the paper with an aqueous composition containing pigment and a thermoplastic binder. The paper is then initially dried at a temperature of up to about 20° F. above the minimum film-forming temperature of the binder until the moisture content of the sheet reaches from about 8 to about 18% by weight. The drying temperature is then increased to further dry the paper, and the dry coated paper is then calendered.

7 Claims, No Drawings

METHOD FOR COATING AND DRYING PAPER

BACKGROUND OF THE INVENTION

This invention relates to methods for making coated papers wherein the coating contains thermoplastic binders and more particularly to method wherein the coated paper is subjected to an efficient multiple stage drying sequence prior to calendering to produce a coated paper having high bulk, excellent gloss and low surface mottle.

The methods for producing a coated paper are well known. An aqueous coating composition is continuously applied to a moving web, the coating composition typically containing one or more pigments such as clay, and an organic binder. The coated paper is then dried and subjected to a calendering operation to produce the desired level of gloss. Conventional methods of calendering include supercalendering and gloss calendering.

In some instances, it is desirable to obtain a finished coating that has a high degree of bulk together with acceptable gloss. High bulk papers are usually finished by gloss calendering wherein the coated web is brought between the nip of a heated, polished roll and a resilient backing roll, using relatively low pressures and high temperatures compared to supercalendering. As the coated surface of the paper contacts the heated drum, the binder is softened and the coating is smoothed without undue compacing of coating.

In the art of applying high gloss coatings, it is known to utilize thermoplasic polymers having relatively high minimum film forming temperature or glass transition temperature, e.g., in the order of 95° to 135° F. The minimum film forming or glass transition temperature of a binder is generally the temperature above which the binder particles start to melt or become plastic. The use of such binders is generally described in the following U.S. Pat. Nos. 3,028,258; 3,268,354; 3,583,881; 3,664,912; 3,873,345; 4,012,543; 4,102,737 and 4,112,192.

The Hain U.S. Pat. No. 3,268,354 describes the preparation of coated papers wherein the coating may contain pigment and a thermoplastic binder. The coated paper is then partially dried at temperatures below the minimum filmforming temperature of the binder such that the binder particles in the coating remain uncoalesced. The paper is calendered while substantially wet, causing significant pressure deformation of the paper web, and also causing the binder to fuse and form a glossy film with the pigment.

Other references that teach the advantages of providing a coating wherein the binder is uncoalesced are U.S. Pat. Nos. 3,873,345 and 4,112,192. In order to maintain the binder in an uncoalesced state, the temperaure during drying is kept below the minimum film forming temperature of the binder. In accordance with some of the other aforementioned references, the binder is coalesced while drying at a relatively high temperature before calendering.

It has been found that drying at a temperature below the minimum film forming temperature of the binder is inefficient because of the excessive time required in the dryer. On the other hand, the use of conventional higher drying temperatures does not result in the development of the desired degree of gloss in the final product.

SUMMARY OF THE INVENTION

In accordance with the present invention, a high gloss, high bulk coated paper is produced wherein the coating contains a thermoplastic binder having a minimum film forming temperature in the order of from about 85° to about 135° F. It has been found that the final physical properties of the coated paper can be enhanced by utilizing a multiple stage drying procedure wherein the initial drying temperature is in excess of the minimum film forming temperature of the binder and up to 20° F. in excess of such temperature, whereby drying efficiencies are improved. When the moisture content of the sheet has been reduced to below about 8 to 18% by weight, the drying temperature may be increased substantially until the desired final dryness is obtained, without detriment to the final product, thereby further improving drying efficiency. The coated web is then gloss calendered, resulting in a high bulk, high gloss coated paper.

DESCRIPTION OF THE PREFERRED EMBODIMENT

In accordance with the preferred embodiment, an aqueous coating composition containing a thermoplastic binder is coated onto a moving web of paper by conventional methods, such as by blade coating. Although not critical to the invention, typical coatings in the order to 5 to 12 pounds of coating per ream (3000 $ft^2$) are preferably applied on each side of the web to prime coated paper having a basis weight in the order of 50 to 115 pounds.

Except for the presence of a particular binder, the coating composition is essentially conventional in nature and will typically comprise a large percentage of clay, plus optional pigments known to produce desirable properties in the final product. A suitable composition, for example, will include in excess of 60% clay with the remainder as other pigments. As a specific example, the solids may consist of 85% clay, 10% calcium carbonate and 5% titanium dioxide.

The binder is one classified as a thermoplastic polymer having a minimum filmforming temperature above room temperature and preferably in the order of from about 85° to about 135° F., with the amount of binder in the composition at the level of from about 15 to about 30 parts binder to 100 parts of the pigment. Particularly suitable binders comprise styrene butadiene and styrene acrylic latexes. In a typical aqueous coating composition, the percentage of solids will be in the order of 55 to 65 percent, although the percentage of solids in the coating as applied is not critical to the present invention.

In accordance with the present invention, the coated paper is then dried in accordance with a specific procedure, which results in substantial benefits in drying efficiencies without detriment to the final properties of the finished product.

In particular, the coated paper is first dried at a temperature such that the surface of the coating, as measured by conventional methods is above the minimum filmforming temperature of the particular binder being employed and preferably up to about 10° to about 20° F. above said minimum temperature. In the alternative, a lower drying temperature may be employed, although the time required for drying will be proportionally increased. In either event, the binder in the coating remains unfused or uncoalesced.

The foregoing drying period is continued until the total sheet moisture reaches approximately 8 to about 18 percent by weight, the drying temperature is then increased substantially above the minimum filmforming temperature of the binder, i.e., higher than 20° F. above the minimum filmforming temperature, and drying is continued until the desired degree of dryness in the web is obtained, usually in the order of from about 4 to about 6 percent by weight. Notwithstanding the imposition of a substantially higher drying temperature at this stage, which may be in excess of 50° F. over the minimum filmforming temperature of the binder, the binder remains uncoalesced. Preferably, however, the final web temperature is below 180° F. and ideally below 170° F.

It is believed that when the coated paper is substantially wet, a high drying temperature tends to render the binder particles more mobile, causing them to coalesce and bind the pigment. Coalescence of the binder prior to calendering in turn causes an unacceptable loss in gloss, presumably because the bound pigment is not as easily smoothed by the calender roll.

After the amount of available moisture in the coated paper has been reduced substantially, it has been unexpectedly found that the surface temperature of the coating may be increased to a level substantially higher than the minimum filmforming temperature of the binder without causing the binder particles to coalesce or lose their separate identities. The use of higher temperatures allows for a shorter drying time and fewer drying stations. In addition, for reasons not fully understood, the drying sequence results in substantially reduced surface mottle or galvanized appearance in the final product.

After the coated sheet is dried in the aforesaid manner, the sheet is calendered, preferably by conventional gloss calendering methods, wherein the sheet is passed through a pair of rolls, one of which is polished and heated. Typical surface temperatures of the calender roll are from about 275° to about 350° F., with nip pressures in the order of 500 to 900 pli. Typically, the web is passed through several pairs of nips to produce a glossy surface on the coated paper. The calendering serves to soften the binder, allowing high gloss to be attained without unduly compacing the coating.

In further describing the invention, the following example is given.

EXAMPLE 1

The following coating composition was prepared (expressed in parts).

85—delaminated clay
5—precipitated calcium carbonate
5—ground calcium carbonate
5—titanium dioxide
20—styrene acrylic latex having a minimum film forming temperature of 94° F.

The coating composition was prepared to contain 60% solids and had a pH of 8.5 and a viscosity of 3400 cps Brookfield at 20 rpm.

The coating was applied by inverted blade coater onto a size press paper web at a rate of about 8 pounds on each side per ream (3300 sq. ft.). The web was then initially dried up to a maximum temperature in the web of about 112° F. until the moisture content of the web was 9.7%. The web was then subjected to additional drying at web temperatures between 130° and 140° F. until the moisture content was 5.1%.

The web was then gloss calendered at 1200 fpm web speed wherein the polished roll temperature was 310° to 320° F. and at a nip pressure of 700 pli.

The resulting web had a calendered gloss of 79—79, a print gloss of 98, a print smoothness of 20–40, and brightness of 83.7.

I claim:

1. A method for coating and drying a web of paper comprising the steps of applying a coating to said web, said coating comprising a coating pigment and a thermoplastic polymer having a minimum filmforming temperature (MFFT) of from about 85° to about 135° F., initially drying the web at a web temperature above the MFFT and below 20° F. in excess of the MFFT until the moisture content of the web is from about 8 to about 18 percent by weight, then continuing to dry the web at a temperature higher than the initial web temperature until the final desired degree of dryness is attained, and then calendering the dried coated web.

2. The method of claim 1 wherein the web is initially dried at a temperature of from about 10° to about 20° above the MFFT of the binder.

3. The method of claim 1 wherein said higher temperature is in excess of 20° F. above said MFFT.

4. The method of claim 1 wherein the final dryness of the web is from about 4 to 6 percent by weight.

5. The method of claim 1 wherein said higher temperature is below about 180° F.

6. The method of claim 1 wherein the dried coated web is gloss calendered.

7. The product of the process of claim 1.

* * * * *